US010713895B2

(12) United States Patent
Pececnik et al.

(10) Patent No.: US 10,713,895 B2
(45) Date of Patent: Jul. 14, 2020

(54) DEMONSTRATION MODE IN SKILL-BASED GAMING TECHNOLOGY

(71) Applicant: Interblock d.d., Menges (SI)

(72) Inventors: Joze Pececnik, Smarca (SI); Mark A. Litman, Edina, MN (US)

(73) Assignee: INTERBLOCK D.D., Menges (SI)

( * ) Notice: Subject to any disclaimer, the term of this patent is extended or adjusted under 35 U.S.C. 154(b) by 205 days.

(21) Appl. No.: 14/867,290

(22) Filed: Sep. 28, 2015

(65) Prior Publication Data

US 2017/0092069 A1 Mar. 30, 2017

(51) Int. Cl.
*G07F 17/32* (2006.01)

(52) U.S. Cl.
CPC ..... *G07F 17/3262* (2013.01); *G07F 17/323* (2013.01); *G07F 17/3209* (2013.01); *G07F 17/3211* (2013.01); *G07F 17/3244* (2013.01); *G07F 17/3269* (2013.01)

(58) Field of Classification Search
CPC ..... G07F 17/3262; G07F 17/3209; G07F 17/3211; G07F 17/323; G07F 17/3244; G07F 17/3269
See application file for complete search history.

(56) References Cited

U.S. PATENT DOCUMENTS 5,324,035 A 6/1994 Morris et al.
5,551,692 A 9/1996 Plourd et al.
6,142,872 A * 11/2000 Walker ..... G07F 17/32 340/323 R
7,220,180 B2 5/2007 Kaminkow et al.
7,294,056 B2 11/2007 Lowell et al.
8,337,294 B2 12/2012 Sharkov et al.
2002/0045474 A1* 4/2002 Singer ..... G07F 17/32 463/20
2004/0024670 A1* 2/2004 Valenzuela ..... G06F 21/10 705/35
2004/0171419 A1* 9/2004 Walker ..... G07F 17/32 463/20
2004/0185931 A1 9/2004 Lowell et al.
2005/0143159 A1 6/2005 Kaminkow et al.
2006/0040735 A1* 2/2006 Baerlocher ..... G07F 17/32 463/26
2006/0094498 A1* 5/2006 Jorasch ..... A44C 21/00 463/25
2006/0258422 A1* 11/2006 Walker ..... G07F 17/32 463/7

(Continued)

*Primary Examiner* — Werner G Garner
(74) *Attorney, Agent, or Firm* — BakerHostetler

(57) ABSTRACT

A gaming apparatus having electronic input controls therein includes:

a player input panel;

a video display system; and a gaming processor.

The player input panel may have a first input control specific to providing a command to the gaming processor and the player input panel. The command enables a second player input control on the player input panel. This second player input control is specific to alteration of game play so that physical activity at the player panel will enter commands to the gaming controller to execute gaming play without placing any economic value at risk during a demonstration period. The gaming processor allows the demonstration period to continue for only a predetermined time limit or event occurrence that does not result in resolution of a wager.

19 Claims, 4 Drawing Sheets

(56) References Cited

U.S. PATENT DOCUMENTS

| | | | | |
|---|---|---|---|---|
| 2008/0248865 | A1* | 10/2008 | Tedesco | G07F 17/3248 463/25 |
| 2012/0071223 | A1 | 3/2012 | Sharkov et al. | |
| 2013/0244765 | A1* | 9/2013 | Arnone | G07F 17/3225 463/25 |
| 2015/0231492 | A1* | 8/2015 | Shah | A63F 13/22 463/31 |

* cited by examiner

DEMONSTRATION MODE IN SKILL-BASED GAMING TECHNOLOGY

BACKGROUND OF THE ART

1. Field of the Invention

The present invention relates to electronic wagering gaming devices in which a non-wagering modality can be provided to a player. The non-wagering modality may also include skill-based performance to enable practice of the skill-based input.

2. Background of the Art

Electronic gaming, especially electronic gaming machines which simulate slot reel machines and other systems in which there are random distributions of arrays of symbols still constitute the bulk of profits in the United States and other countries, even though the largest wagering amounts are present in baccarat and blackjack. It has always been felt to be desirable to introduce new variations in electronic gaming machines (EGMs) so that players do not get fatigued with old games, and to attract new players to games, especially using new themes or characters to which players might relate. This route of changing games and images, while still automatically providing game play without substantive player input has reached a relatively stable position within the industry. Without adding substantive content to EGM play, the life of new games has shortened and revenues have remained flat.

In September of 2015, some gaming jurisdictions in the United States finally allowed some level of skill-based gaming to be used in conjunction with EGM play. The type of skill has to be carefully selected, or the house advantage could be dramatically shifted to players and the casinos could lose substantial funds. For example, even though question based skill (e.g., as in Jeopardy® games) could be used, more intelligent or knowledgeable players would have a significant advantage over players. Also, with information readily and quickly available to players through smart phones and other communication devices, players could obtain information-based question responses with outside assistance.

The more preferable type of skill to be allowed in the play of gaming systems will be more manual or physical input by players such as rapidity of button or touchscreen entry, proper ordering of button or touchscreen entry, correct manipulation of joy-sticks, correct manipulation of touchscreen objects, controlled direction of objects/projectiles, proper control of wheels (e.g., steering wheels) or levers, control or completion of timed events, length of activity in timed events (especially with increasing levels of difficulty) and other events requiring actual activity by players that include physical control of images and objects beyond random outcomes initiated by acceptance of a wager.

One set of problems in offering these new skill-based games is the concern that players are not willing to risk significant amounts of funds in a learning experience and that the games may languish on the floor. Although it has been known to offer demonstration modes in new games, these demonstration modes have typically been video play which shows how to place wagers, how to initiate games, how the games perform during activity and the like, but there has been no mechanism for enabling actual skill-based player input to the games without a costly learning curve for players. The rapid turnover rate for wagering on EGMs during game play, is quite different from the unlimited time for players to learn on home entertainment systems, where neither cost nor time is a factor.

U.S. Pat. No. 5,324,035 (Morris); U.S. Pat. No. 5,551,692 (Pettit); U.S. Pat. No. 7,220,180 (Kaminkow); and U.S. Pat. No. 7,294,056 (Lowell) demonstration mode show demonstration modes, demonstration loops and non-cash auto-play.

U.S. Pat. No. 8,337,294 (Sharkov) provides a typical description of demonstration modes. Turning to FIGS. 10-14, the system may include a demonstration feature 80 so that potential users may learn how to use the system without having to wager their own funds. Selecting the demonstration option 82 may launch a mock-version of the game. The mock-version may show the user how to place a bet, how to spin the reels to determine which bets will be part of the combi-bet, and how to view and analyze the user interface to determine whether the combi-bet is a winner. At any point during the demonstration, the system may allow the user to exit the demonstration and proceed to the actual wagering portion of the system.

Novel technology is needed to address the learning curve during the attraction period for players into the use of new gaming technology.

SUMMARY OF THE INVENTION

A gaming apparatus having electronic input controls therein (including a video display gaming apparatus) may be provided with:

a player input panel;

a video display system; and a gaming processor.

The player input panel may have a first input control specific to providing a command to the gaming processor and the player input panel. The command (ultimately, immediately or after a delay period) enables a second player input control on the player input panel. This second player input control is specific to alteration of game play so that physical activity at the player panel will enter commands to the gaming controller to execute gaming play without placing any economic value at risk during a demonstration period. The gaming processor allows the demonstration period to continue for only a predetermined time limit or event occurrence that does not result in resolution of a wager.

DETAILED DESCRIPTION OF THE INVENTION

Figure 1:
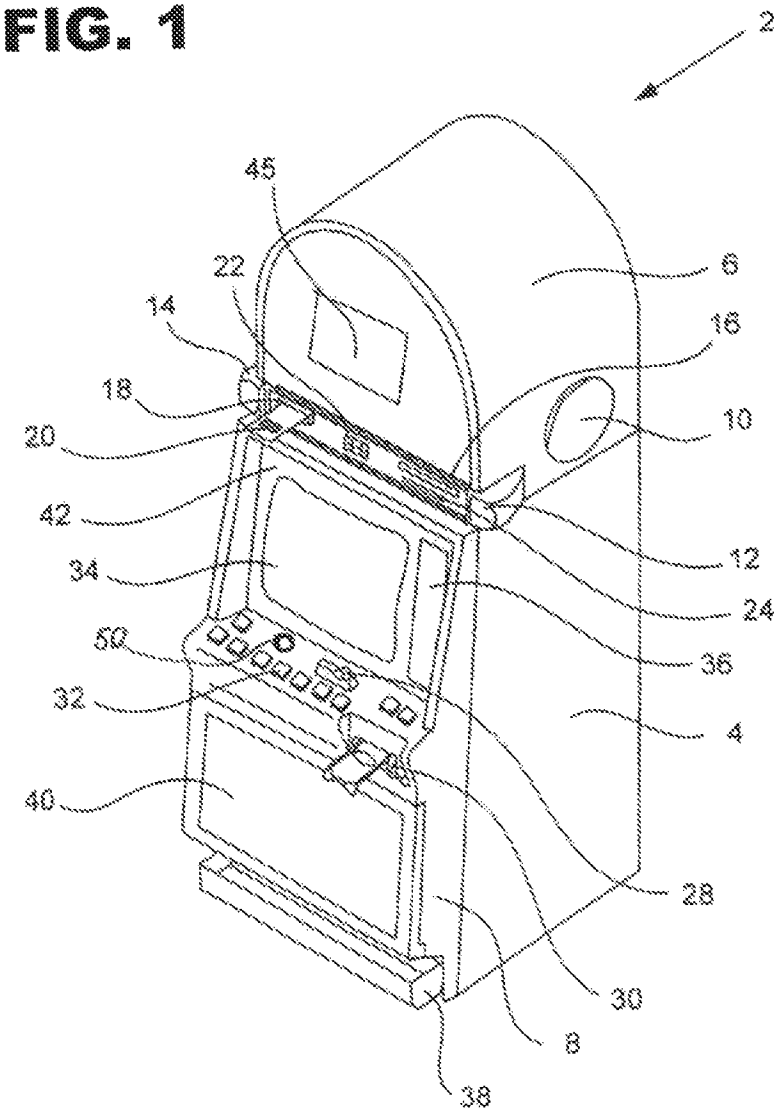
FIG. 1 shows a perspective view of a gaming machine with a skill control input device.

A gaming apparatus having electronic input controls therein (including a video display gaming apparatus) may be provided with:

a player input panel;

a video display system; and a gaming processor.

The player input panel may have a first input control specific to providing a command to the gaming processor and the player input panel. The command (ultimately, immediately or after a delay period) enables a second player input control on the player input panel. This second player input control is specific to alteration of game play so that physical activity at the player panel will enter commands to the gaming controller to execute gaming play without placing any economic value at risk during a demonstration period. The gaming processor allows the demonstration period to continue for only a predetermined time limit or event occurrence that does not result in resolution of a wager.

It is to be noted that the preferred embodiment of the present technology is wherein there is a training or demonstration period during which player input controls gaming activity with no wagering outcome being determined. Controlled gaming activity means physical or virtual control of direction or speed or movement, numbers of elements (physical or virtual) being moved, the control being manually (including vocally or retinal control) by a player. The elements (physical or virtual) may be moved through mazes, bypass hurdles, strike targets, avoid traps, uncover treasure, direct avatars or images in an adventure, play pinball events, shoot projectiles at targets or enemies, rolling balls towards targets (pins or holes), and other known skill-type events that can be implemented in a machine.

The apparatus may provide a player input panel that enables entry of player skill into the game processor through at least one input component selected from the group consisting of joysticks, multiple buttons, roller balls, pumps, virtual guns, steering wheels, direction sensitive and/or pressure sensitive touchscreen input zones, and voice entry sensor. The apparatus may provide a player input panel that is configured to enable entry of a level of player skill to be executed during the demonstration period into the game processor through at least one input component on the player input panel allows player input specific to selection of a level of skill complexity. There may be a sliding scale, progressive button(s), rated icons, speedometer, alphanumeric dial, scale, or any other indicator of a level of difficulty that can be selected and/or adjusted during demonstration time. For example, in a demonstration period in which the skill event is maneuvering a virtual car through a complex series of streets, the selection of skill level may establish a range of virtual speeds, such as 25 kilometers/hour (kph), 35 kph, 50 kph, 60 kph or 75 kph. The selection of speeds may be used to ease into understanding of game controls, subtleties of controls, types of obstacles, and the like. In a virtual or mechanical boxers, speed of punches and number of punches/minute may be selected. In a target shooting event (virtual or physical) wind speeds and distances of targets may be altered. These differences may be indicative of actual levels of difficulty that can occur during a skill event for a wagering event. The different levels of skill may provide different paytables or enable different paytables to be won during the skill aspect of play before the actual wagering event. For example, if a virtual gun were provided with 10 shots to hit moving bullseye targets, as the speed of target movement and amount of time to fire all shots changes from an easiest level (slow targets and 20 seconds to fire) to a hardest level (fast moving targets and 10 seconds to fire all bullets), higher success levels may alter paytables (as in a video poker game) between various levels, such as:

Lowest Achievement Level

| | |
|---|---|
| 2 Pair | 1:1 |
| 3-of-a-Kind | 2:1 |
| Straight | 3:1 |
| Flush | 4:1 |
| Full House | 5:1 |
| 4-of-a-Kind | 7:1 |
| Straight Flush | 10:1 |

Intermediate Achievement Level

| | |
|---|---|
| 2 Pair | 2:1 |
| 3-of-a-Kind | 3:1 |
| Straight | 4:1 |
| Flush | 5:1 |
| Full House | 7:1 |
| 4-of-a-Kind | 9:1 |
| Straight Flush | 12:1 |

Highest Achievement Level

| | |
|---|---|
| 2 Pair | 2:1 |
| 3-of-a-Kind | 3:1 |
| Straight | 4:1 |
| Flush | 5:1 |
| Full House | 8:1 |
| 4-of-a-Kind | 10:1 |
| Straight Flush | 15:1 |

In this way, the player, in a reasonable amount of time, using some level of skill, advantageously can alter the paytables through successful efforts.

The apparatus may have the game processor configured to receive player input on selection of player input specific to selection of a level of skill complexity, and is configured to then to implement a wagering event with a level of skill complexity within an average range of skill consistent with the selected level of skill complexity. The term average skill complexity or range of skill complexity is used as even during operation of an event, speed, difficulty, directions and target size may be altered, rather than allowing such consistency as to freeze action in the event.

FIG. 1, a video gaming machine 2 that may be used as the underlying base gaming counsel of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2. A roller ball 50 is shown on the device as a skill control device wherein the player may direct movement of a physical object on a top-box or a virtual object on the display screen, By rotation of the roller ball 50, the physical object or virtual object can have speed and direction controlled.

Many different types of games, including mechanical slot games; video slot games, video poker, video black jack, video pachinko and lottery, may be provided with gaming machines of this invention, in particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

It is to be understood that gaming machine 2 is but one example from a wide range of gaming machine designs on which the present invention may be implemented. For example, not, all suitable gaming machines have top boxes or player tracking features. Further, some gaming machines have only a single game display—mechanical or video, while others are designed for bar tables and have, displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device, Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that, gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software, Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred, Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include ETA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of 101 is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet, Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment, of the slot, machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device, in a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information and even a moveable physical object controlled by the roller ball 50 may also be displayed in or through the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
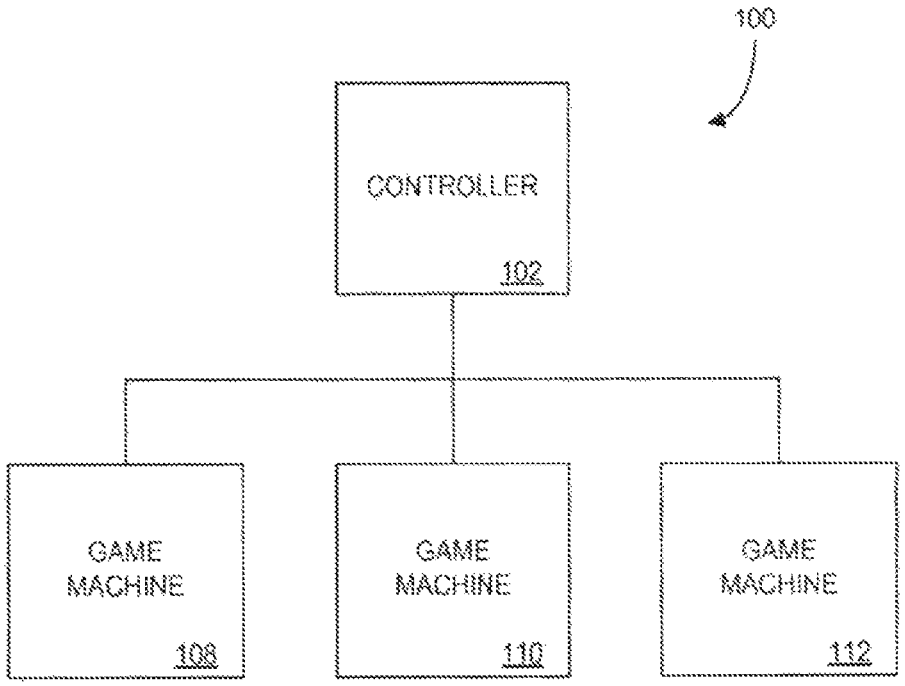
FIG. 1A depicts an exemplary embodiment of the invention with one of many available arrangements of devices.

FIG. 1A depicts only an exemplary embodiment of the invention. Other arrangements of devices to perform various methods specified herein will be readily appreciated by those of skill in the art.

Generally, any of the game machines 108, 110, 112 includes hardware, software, or both, to support operations in accordance with one or more embodiments of the present invention, such as offering or providing a tour of a bonus round, in addition to supporting the primary functionality of the game machine (e.g., providing one or more games of chance and/or skill). For example, game machines 108, 110, 112 may offer a primary slot machine game and a secondary game, such as a three-reeled slot game and its corresponding bonus round, in addition to being fitted with appropriate electronic, mechanical, software and/or electromechanical means for offering, enabling, and/or executing a tour of the secondary game.

In operation, any of the game machines 108, 110, 112 may exchange information (e.g., information about a player) via the controller 102. The game machines 108, 110, 112 may provide information to the controller 102. The controller 102 may provide information to the game machines 108, 110, 112. The controller 102 also may provide various control signals to the game machines 108, 110, 112, directing them to present offers, display game information, generate game outcomes, provide payouts to players, etc.

In some embodiments of the present invention, some operations are performed by a game machine, and other operations are performed by the controller 102. Alternatively, game machines 108, 110, 112 may not include any hardware and/or software to support operations of the present invention, except to merely receive and respond to a signal from the controller 102 (e.g., a signal directing the game machine to dispense a payout).

Devices in the System

Figure 2:
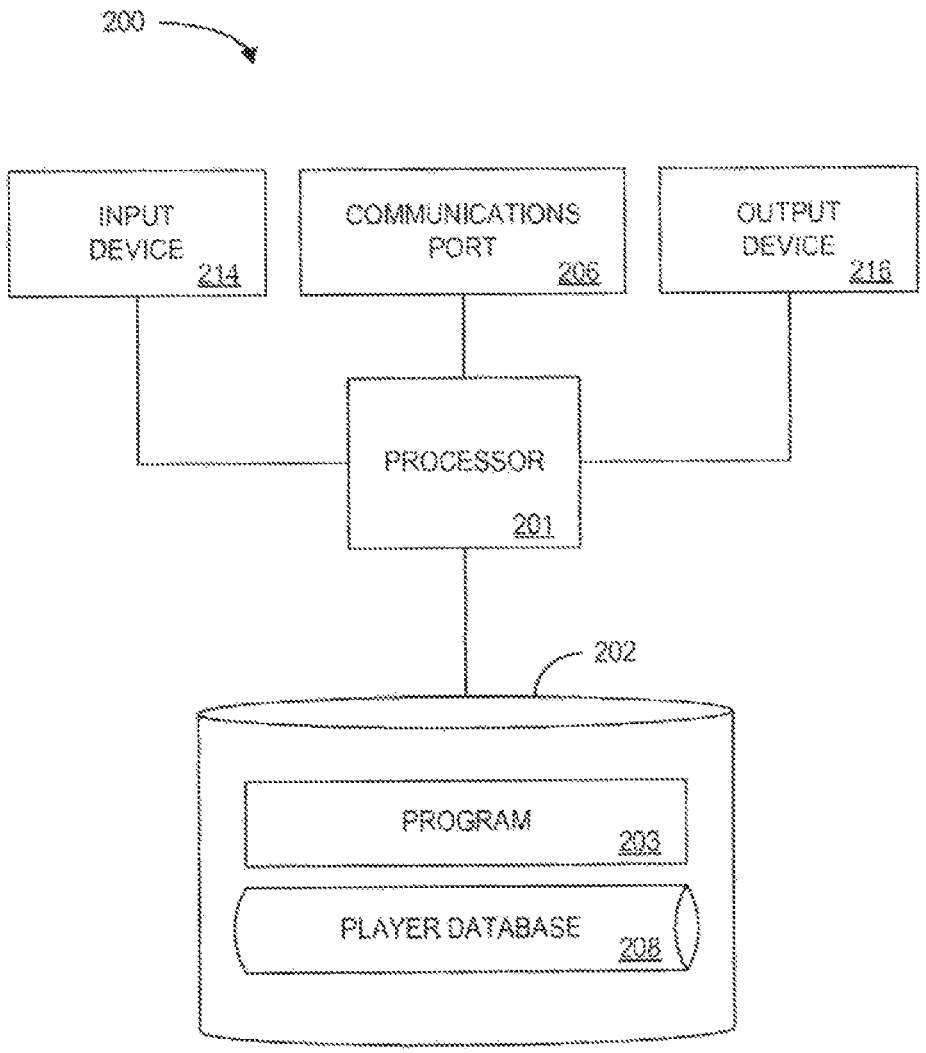
FIG. 2 illustrates an embodiment of the system controller of FIG. 1.

Controller—FIG. 2 illustrates are embodiment of the controller 102 (FIG. 1A). The exemplary controller 200 of FIG. 2 may be implemented as a system controller, a dedicated hardware circuit, an appropriately programmed general-purpose computer, or any other appropriate device including, without limitation, electronic, mechanical or electro-mechanical devices. The controller 200 is operative to execute various methods of the present invention. For example, some or all of the processes for providing a tour of a bonus round may be carried out by the controller 200.

The controller 200 of the illustrated embodiment comprises a processor 201, such as one or more INTEL® PENTIUM® microprocessors. The processor 201 may include or be coupled to one or more clocks or timers (not pictured), and/or one or more communication ports 206 through which the processor 201 may communicate with other devices, such as the game machines 108, 110, 112. The communication port 206 may be, without limitation, a serial port, modem, wireless transmitter/receiver, or the like.

The processor 201 is in communication with a data storage device 202, The data storage device 202 comprises, for example, magnetic memory, optical memory, semiconductor memory, or any combination thereof. The data storage device 202 may also include, for example, one or more additional processors, communication ports, Random Access Memory (RAM), Read-Only Memory (ROM), a compact disc and/or a hard disk. The processor 201 and the storage device 202 may each be, for example: (i) located entirely within a single computer or other computing device; or (ii) connected to each other by a remote communication medium including, without limitation, a serial port cable, a LAN, a telephone line, a fiber optic connection, a network connection, or a radio frequency transceiver. In some embodiments, the controller 200 may comprise one or more computing devices that are connected to a remote server computer operative for maintaining databases.

The data storage device 202 stores a program 203 for controlling the processor 201. The processor 201 performs instructions of the program 203 (e.g., computer program code and/or a computer program product), and thereby operates in accordance with the present invention, and particularly in accordance with the methods described in detail herein. The program 203 may be stored in a compressed, uncompiled and/or encrypted format, as well as in a variety of other forms known in the art. The program 203 furthermore includes program elements that may be necessary, including, without limitation, an operating system, a database management system and "device drivers" for allowing the processor 201 to interface with one or more peripheral devices. Appropriate program elements are well known to those skilled in the art, and need not be described in detail herein.

According to some embodiments of the present invention, the instructions of the program 203 may be read into a main memory from another computer-readable medium, such as into RAM from a hard drive or ROM. Execution of sequences of the instructions in program 203 may cause the processor 201 to perform any of various process steps described herein. In alternative embodiments, hard-wired circuitry may be used in place of, or in combination with, software instructions for implementation of one or more processes of the present invention, as would be understood by those of skill in the art. Thus, embodiments of the present invention are not limited to hardware, software or any specific combination of hardware, firmware, and/or software.

Further, the program 203 is operative to execute a number of modules or subroutines including, but not limited to: (i) one or more routines to identify a player at a game machine as a potential candidate to be offered a tour of a secondary game; (ii) one or more routines to receive information about a player; (iii) one or more routines to offer a tour of a secondary game to a player; (iv) one or more routines to determine if a player accepts an offer for a tour; (v) one or more routines to determine an outcome in a secondary game; (vi) one or more routines to determine whether an outcome occurred during normal play of a secondary game or during a tutorial for the secondary game; (vii) one or more routines to determine a prize based on whether an outcome in a secondary game occurred during normal play or occurred during a tour of the secondary game; (viii) one or more routines to signal game machines 108, 110, 112 to dispense a payout to a player; (ix) one or more routines to signal a game machine to provide a benefit to a player; (x) one or more routines to signal a game machine to prompt a player to take a tour; (xi) one or more routines to determine a lesson to provide to a player; (xii) one or more routines to facilitate and control communications between one or more game machines and the controller 200 and/or communications among the game machines; (xiii) one or more routines to prevent a player from touring a game machine; and (xiv) one or more routines to control databases or software objects that track information regarding players, lessons for secondary games, prizes for secondary games and game machines 108, 110, 112.

The storage device 202 also stores a player database 208. The database is described in detail below and depicted with exemplary entries in the accompanying figures. As will be understood by those skilled in the art, the schematic illustrations and accompanying descriptions of the databases presented herein are exemplary arrangements for stored representations of information. A number of other arrangements may be employed besides those suggested by the tables shown. For example, those skilled in the art will understand that the number and/or content of the databases can be different from those illustrated herein. Similarly, the illustrated entries of the databases represent exemplary information only; those skilled in the art will understand that the number and/or content of the entries can be different from those illustrated herein.

The processor 201 may also be in communication with at least one input device 214, which may be used to receive input from an operator (e.g., a casino employee) or other user of the controller 200. Input device 214 may comprise any number or combination of a variety of well-known devices, including, without limitation: a button, a touch screen, a keypad, a pointer device (e.g., a mouse, a trackball), a microphone, a video camera, and a keyboard. Other types of input devices are described herein; others will be readily apparent to those skilled in the art.

The processor 201 may also be in communication with at least one output device 216, which may be used to communicate information to an operator or other user of the controller 200. Output device 216 may comprise any number or combination of a variety of well-known devices, including, without limitation: a display device, a light-emitting diode (LED), an audio speaker, a printer, and an infra-red port (e.g., for communicating with a handheld device). Other types of output devices are described herein; others will be readily apparent to those skilled in the art.

Game Machine

Figure 3:
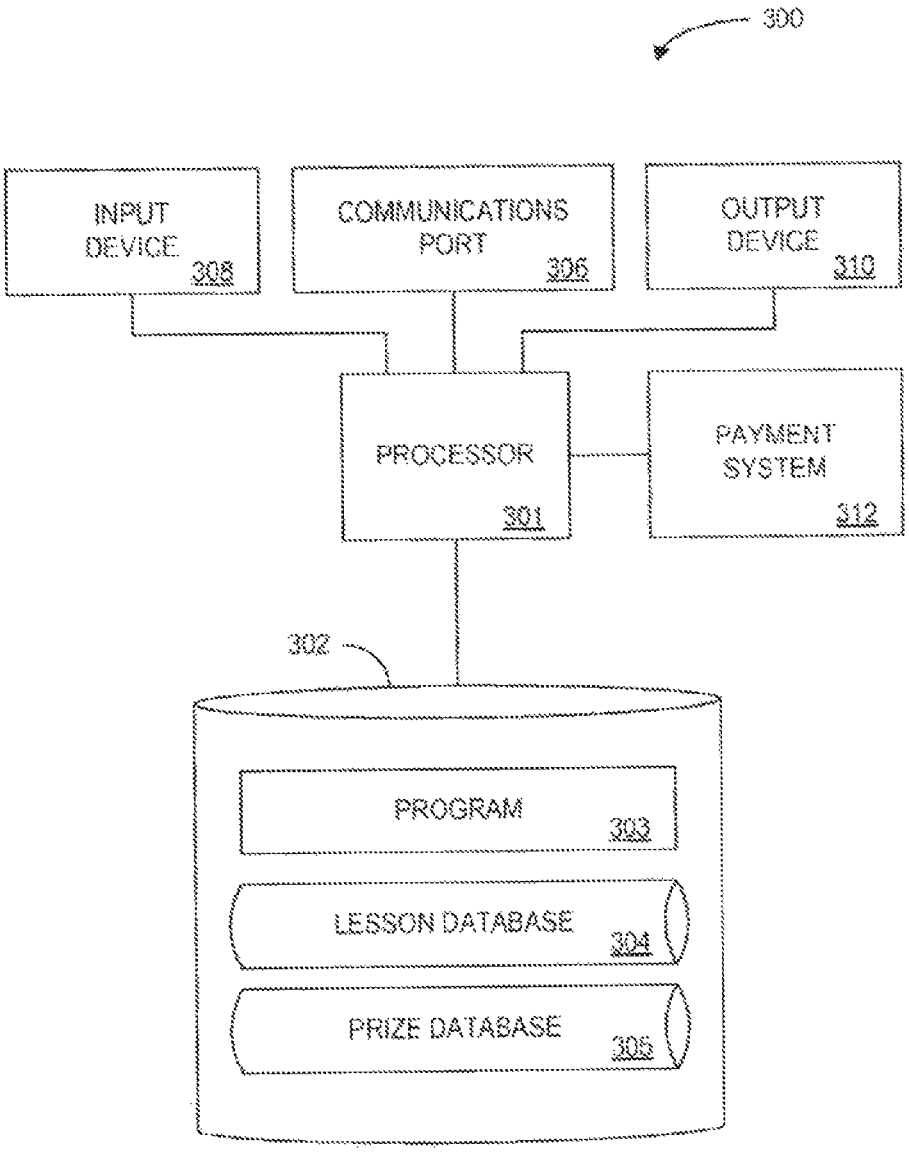
FIG. 3 illustrates an exemplary schematic embodiment of game machines useful in the practice of the present invention.

FIG. 3 illustrates an exemplary embodiment of the game machines 108, 110, 112 (FIG. 1A). Well-known examples of game machines include, without limitation, slot machines, video poker machines, video blackjack machines, video keno machines, video lottery terminals, video bingo machines, pachinko machines, table-top games (e.g., as may typically be located in a bar or other commercial establishment), a personal computer (e.g., to communicate with a Web site that provides gambling services), a telephone (e.g., to communicate with an automated sports book that provides gambling services), a portable handheld device (e.g., a PDA, a GAMEBOY™ devices manufactured by NINTENDO), hardware located at a game table (e.g., suitable for entering a player identifier and/or an average wager size), video roulette machines, a skill crane, a video game, an arcade terminal, and reeled slot machines (e.g., mechanical and/or video reel slot machines).

The exemplary game machine 300 of FIG. 3 may be implemented as a system controller, a dedicated hardware circuit, a dedicated terminal (e.g., having one or more functions directed remotely by a controller), an appropriately programmed general-purpose computer, or any other appropriate device including, without limitation, electronic, mechanical or electro-mechanical devices. The game machine 300 is operative to provide for various embodiments of the present invention. For example, some or all of the processes for providing a tour of a secondary game may be carried out by the game machine 300.

The game machine 300 comprises a processor 301, such as one or more INTEL® PENTIUM9r0 microprocessors. The processor 301 is in communication with a data storage device 302. The data storage device 302 comprises, for example, magnetic memory, optical memory, semiconductor memory, or any combination thereof. The data storage device 302 may also include, for example, one or more additional processors, communication ports, Random Access Memory (RAM), Read-Only Memory (ROM), a compact disc and/or a hard disk. The processor 301 and the storage device 302 may each be, for example: (i) located entirely within a single computer or other computing device; or (ii) connected to each other by a remote communication medium including, without limitation, a serial port cable, a LAN, a telephone line, a fiber optic connection, a network connection, or a radio frequency transceiver. In some embodiments, the game machine 300 may comprise one or more computing devices that are connected to a remote server computer operative for maintaining databases.

The data storage device 302 preferably stores a program 303 (e.g., computer program code and/or a computer program product) for controlling the processor 301. The processor 301 may perform instructions of the program 303, and thereby operate in accordance with one or more embodiments of the present invention, and particularly in accordance with one or more of the methods described in detail herein. For example, the controller 200 may transmit a control signal to game machine 300 to execute various instructions of the program 303. Data, including program 303, may be stored in the data storage device in a compressed, uncompiled and/or encrypted format, as well as in a variety of other forms known in the art. The data storage device 302 also preferably stores program elements that may be necessary, including, without limitation, an operating system, a database management system and "device drivers" for allowing the processor 301 to interface with one or more peripheral devices. Appropriate program elements are well known to those skilled in the art, and need not be described in detail herein:

According to some embodiments of the present invention, information, including program 303, may be read into a main memory from another computer-readable medium, such as into RAM from a hard drive or ROM. Execution of sequences of the instructions in stored program 303 may cause the processor 301 to perform any of various process steps described herein. In alternative embodiments, hard-wired circuitry may be used in place of, or in combination with, software instructions for implementation of one or more processes of the present invention. Thus, embodiments of the present invention are not limited to hardware, software or any specific combination of hardware, firmware, and/or software.

The storage device 302 also stores (i) a lesson database 304, and (ii) a prize database 305. The databases are described in detail below and depicted with exemplary entries in the accompanying figures.

The processor 301 may include or be coupled to one or more clocks or timers (not pictured), and/or one or more communication ports 306 through which the processor 301 may communicate with other devices, such as the controller 200, a peripheral device (e.g., an input device, an output device) and/or another game machine. The communication port 306 may be, without limitation, a serial port, modem, wireless transmitter/receiver, or the like.

The processor 301 may also be in communication with at least one input device 308, which may be used to receive input from a player or other user of the game machine. Input device 308 may comprise any number or combination of a variety of well-known devices, including, without limitation: a button, a touch screen, a handle (e.g., a slot machine handle), a keypad, a pointer device (e.g., a mouse, a trackball), a microphone, a keyboard, a video camera, a magnetic stripe reader (e.g., for performing functions related to player tracking cards, such as accepting and reading player tracking cards and communicating information read from such cards to the processor 301), a biometric input device (e.g., a fingerprint or retinal scanner), a radio antenna (e.g., for receiving inputs from a handheld device), a voice recognition module, and a coin and/or bill acceptor.

Input device 308 may comprise, for example, a ticket reader which is capable of reading, for example, receipts, coupons, vouchers, cashless gaming receipts and/or tickets, and particularly indicia registered on any such substrates. The ticket reader may use optical sensing of printed indicia and optical character recognition, for example, to read indicia from a ticket inserted in the ticket reader.

Input device 308 may comprise, for example, a credit card reader. Such devices are known in the art, and generally allow a card such as a credit card or debit card to be inserted therewithin. The card may include a magnetic stripe or other form of data storage, which the credit card reader is capable of sensing and interpreting. Typically, the credit card reader allows a credit card transaction to be processed by communication with a credit card clearinghouse in a manner known in the art.

The processor 301 may also be in communication with at least one output device 310, which may be used to output information to a player or other user of the game machine. Output device 308 may comprise any number or combination of a variety of well-known devices, including, without limitation: a display device, a light-emitting diode (LED), an audio speaker, an electric motor, a printer, a coupon or product dispenser, an infra-red port (e.g., for communicating with a second game machine), a Braille computer monitor, a coin and/or bill dispenser, a bell, an LED display (e.g., for displaying a players credit balance).

Output device 310 may include, for example, a printer in communication with processor 301. The printer may be commanded to print onto a substrate, such as paper or other material. Printing may be via ink jet, laser printing or other methodology for registering indicia on a substrate. Alternatively, the substrate may be registered with indicia by deforming the substrate in a variety of ways known in the art, including, without limitation, punching holes in the substrate and raising and/or lowering portions of the substrate relative to other portions. The printer may be used for printing, e.g., receipts, coupons, vouchers, cashless gaming receipts and/or tickets.

Output device 310 may comprise, for example, one or more display devices, operable to display messages, animation, images, text, and/or graphics in a manner known in the art. Typical display devices include, without limitation, liquid crystal displays, plasma displays and video display monitors.

The processor 301 may also be in communication with a payment system 312 for accepting payment from a player (e.g., a wager) and providing payment to a player (e.g., a prize). It will be readily understood that payment is not limited to coins or cash, but may include other types of consideration, such as a product, a service, a credit, or an alternate currency. The payment system 312 may be operable to perform one or more operations, including, without limitation, one or more of: (i) receiving hard currency (i.e., coins or bills), for example, via a coin or bill acceptor; (ii) receiving an alternate currency (e.g., a paper cashless gaming voucher, a coupon, a casino token); (iii) receiving a payment identifier (e.g., a credit card number, a debit card number, a player tracking card number) and/or debiting a corresponding account; and (iv) determining that a player has performed a value-added activity (e.g., answering a plurality of survey questions); (v) dispensing hard currency; (vi) dispensing an alternate currency; (vii) crediting a player account (e.g., a bank account or other financial account), such as by identifying an account using a payment identifier (e.g., a credit card number, a debit card number, a player tracking card number); and (viii) providing a product or service to the player (e.g., a jackpot prize may be a new car). One or more of the functions of the payment system 312 may be facilitated by the input device 308 and/or the output device 310.

According to some embodiments of the present invention, the game machine 300 is operable (e.g., in accordance with instructions of program 303) to provide one or more games based on chance and/or skill, in a manner well known in the art. Some examples of games of chance include, without limitation, slot machines, video poker, blackjack, keno, bingo, video poker, and pachinko. Some examples of games of skill include, without limitation, video games, skill cranes, and skee-ball. Game machines providing games of skill may be more appealing to certain players, or may be permitted in areas where it is illegal to gamble on games of chance.

The game machine 300 is preferably operable to provide a primary game or mode (e.g., a basic game, a qualifying round), as well as a secondary game or mode (e.g., a bonus round). For example, the data storage device 302 may store instructions in computer program code and/or a computer program product (e.g., in program 303) for providing a primary game with a bonus round, in a manner known in the art. Alternatively, as is well known in the art, the game machine 300 may be a client or dedicated terminal responsive to signals transmitted by the controller 200 and directing the game machine 300 to provide the primary game and/or the bonus game.

In some but not all primary games, a player must receive a winning outcome (or outcomes) in order to gain entry to a secondary game. In some games, the qualifying outcome need not be a winning outcome (e.g., the outcome need not be associated with a prize). In some games, a player may qualify for a bonus round based on various other factors, such as achieving a predetermined level of activity (e.g., an amount wagered, a rate of play). The various exemplary secondary games, bonus rounds, primary games, and qualifying rounds discussed herein are for illustration only.

It is to be further noted that other variations within the scope of the generic technology described herein may also be practiced within and outside the scope of the following claims. For example, the demonstration period may be paid for, either by payment for time within the play of the non-wagering game (e.g., $5.00 for 15 minutes), or significantly lower (non-payable) wager amounts of $0.01-$0.010) may be wagered on game events during a demonstration period. This will provide both a minimal revenue for the casino and an incentive for players to wager full amounts (e.g., $0.25 to $5.00) for real wagering games. The use of player cards, club cards, casino cards (like frequent flier miles cards) may be used or even required to be inserted in the gaming apparatus during the demonstration period. The player's account may thereby be credited for payments into the training session, player's use of demonstration mode can be tracked, and timed limits of demonstration modes can be enforced so that a player cannot play excessively in demonstration modes to occupy gaming systems without revenue to the casino. For example, a player might be limited to X minutes (e.g., 10, 15, 30 minutes) at a single machine, and may be limited for Y minutes for a single 24 hour period (or 1-4 days) or stay at a casino (e.g., 15 minutes, 30 minutes or 1 hour total) to prevent abuse of the demonstration mode. The player may also use player credits, currency or player points on an identified player account (after insertion of a player card or ID number to the processor) to pay for use of the demonstration mode.

What is claimed:

1. A video display gaming apparatus comprising:

a player input panel comprising a value acceptor selected from the group consisting of a) a coin acceptor, b) a currency acceptor and c) a ticket reader and printer;

a video display system; and a gaming processor;

wherein the player input panel comprises a first input control specific to providing first commands to the gaming processor related to game play and a second player input control specific to providing second commands to the gaming processor altering the game play based on a level of player skill wherein the level of player skill is selected by a player, and corresponds to a complexity of one or more skills to be executed by the player of a game over a period during execution of the game play during one or more of a demonstration period and a second period after the demonstration period, wherein a duration of the demonstration period is based on a predetermined time limit or an event occurrence that does not result in resolution of a wager based on economic value at risk, wherein the game play during the second period is based on the wager and the selected level of player skill, wherein the gaming processor is configured to provide a paytable for the wager during the second period, wherein the paytable is altered based on the level of player skill selected by the player, and wherein the gaming processor is configured to require use of one or more physical cards comprising information associated with a player account during the demonstration period.

2. The apparatus of claim 1 wherein the player input panel enables entry of the selected level of player skill into the gaming processor by the player through at least one input component including one or more of joysticks, multiple buttons, a roller ball, a pump, direction sensitive touchscreen input zones and/or pressure sensitive touchscreen input zones, and a voice entry sensor.

3. The apparatus of claim 2 wherein after ending of the demonstration period, the wager is placed and the second commands are entered by physical activity of the player through the at least one input component.

4. The apparatus of claim 3 wherein the selected level of player skill increases based on successful efforts by the player playing the game during the demonstration period.

5. The apparatus of claim 4 wherein the selected level of player skill entered by the player increases as a result of the game play.

6. The apparatus of claim 2 wherein the selected level of player skill is altered by the player during one or more of the demonstration period and the second period.

7. The apparatus of claim 1 wherein the selected level of player skill is entered during the demonstration period.

8. The apparatus of claim 7 wherein the selected level of player skill is applied during the second period.

9. The apparatus of claim 7 wherein the selected level of player skill is altered prior to the second period.

10. The apparatus of claim 7 wherein after ending of the demonstration period, the wager is placed and the second commands are entered by physical activity of the player through at least one input component.

11. The apparatus of claim 10 wherein the gaming processor is configured to alter the paytable based on an increase in the selected level of player skill during the demonstration period.

12. The apparatus of claim 1 wherein the gaming processor is configured to decrement credit in the video display gaming apparatus or player points on a player account to pay for time during the demonstration period even without the wager.

13. A method of performing a demonstration period on a video display gaming apparatus comprising:

a player input panel comprising a value acceptor selected from the group consisting of a) a coin acceptor, b) a currency acceptor and c) a ticket reader and printer;

a video display system; and a gaming processor;

wherein the player input panel comprises a first input control specific to providing first commands to the gaming processor related to game play and a second player input control specific to providing second commands to the gaming processor altering the game play based on a level of player skill, wherein the level of player skill is selected by a player, and corresponds to complexity of one or more skills to be executed by the player of a game over a period during execution of the game play during the demonstration period, wherein a duration of the demonstration period is based on a predetermined time limit or an event occurrence that does not result in resolution of a wager based on economic value at risk;

the method comprising the gaming processor providing a paytable for the wager during a second period, wherein the paytable is altered based on the level of player skill selected by the player, and requiring use of one or more physical cards comprising information associated with a player account during the demonstration period and then placing the wager on the video display gaming apparatus after the demonstration period.

14. The method of claim 13 wherein physical activity of the player further causes the second commands to be entered to the gaming processor, the physical activity including exercise of player skill through at least one input component including one or more of joysticks, multiple buttons, a roller ball, a pump, direction sensitive touchscreen input zones and/or pressure sensitive touchscreen input zones, and a voice entry sensor.

15. The method of claim 14 wherein the selected level of player skill changes during the demonstration period as a result of the physical activity.

16. The method of claim 14 wherein after ending of the demonstration period, the second commands are entered by the physical activity into the player input panel through the second player input control and through the at least one input component to alter the selected level of player skill for the second period of the game play.

17. The method of claim 16 wherein the gaming processor alters the paytable based on an increase in the selected level of player skill.

18. The method of claim 13 wherein credit in the video display gaming apparatus or currency or player points on a player account are used to pay for the game play during the demonstration period even without the wager.

19. The method of claim 18 wherein the gaming processor is configured to award credit to the video display gaming apparatus or currency or player points to the player account as a result of the game play.

* * * * *